United States Patent [19]

Yajima

[11] 4,088,854

[45] May 9, 1978

[54] ELECTRONIC TIMEPIECE SWITCH MECHANISM HAVING SUBSTRATE MOUNTED PIVOTED CONTACT AND LEVER OR CAM ACTUATOR

[75] Inventor: Kenji Yajima, Toda, Japan

[73] Assignee: Kabushiki Kaisha Daini Seikosha, Japan

[21] Appl. No.: 708,036

[22] Filed: Jul. 23, 1976

[30] Foreign Application Priority Data

| | | |
|---|---|---|
| Jul. 24, 1975 | Japan | 50-90564 |
| Jul. 24, 1975 | Japan | 50-90565 |
| Jul. 24, 1975 | Japan | 50-90566 |

[51] Int. Cl.[2] ..... H01H 19/10

[52] U.S. Cl. ..... 200/6 R; 58/23 R; 58/50 R; 58/85.5; 200/6 B; 200/6 BA

[58] Field of Search ..... 200/1 R, 1 B, 5 R, 6 R, 200/6 B, 6 BA, 6 BB, 6 C, 4, 7, 238, 239, 292, 245–247; 58/23 R, 23 A, 23 BA, 50 R, 85.5, 4 A

[56] References Cited

U.S. PATENT DOCUMENTS

| | | | |
|---|---|---|---|
| 2,427,483 | 9/1947 | Weiner | 200/6 R |
| 3,670,117 | 6/1972 | Yancey | 200/5 R X |
| 3,874,162 | 4/1975 | Boxberger et al. | 200/6 BA |
| 3,945,190 | 3/1976 | Kimura et al. | 58/4 A |
| 3,978,296 | 8/1976 | Moriya et al. | 200/6 R |

FOREIGN PATENT DOCUMENTS

| | | | |
|---|---|---|---|
| 1,171,082 | 11/1969 | United Kingdom | 200/5 R |

*Primary Examiner*—James R. Scott

*Attorney, Agent, or Firm*—Robert E. Burns; Emmanuel J. Lobato; Bruce L. Adams

[57] ABSTRACT

In a switch mechanism for an electronic timepiece, stationary switch electrodes are fitted in openings provided in a dielectric base plate. Movable contacts on a pivoted switch lever extend into the openings and are normally out of contact with the electrodes. The switch lever is movable by operation of the watch stem to bring one or another of the movable contacts into engagement with the respective electrode and thereby close the circuit, for example for adjusting the hour and minute displays of the timepiece. This construction permits making the timepiece thin.

7 Claims, 11 Drawing Figures

ELECTRONIC TIMEPIECE SWITCH MECHANISM HAVING SUBSTRATE MOUNTED PIVOTED CONTACT AND LEVER OR CAM ACTUATOR

FIELD OF INVENTION

The present invention relates to electronic timepieces and particularly to a switch mechanism for setting or adjusting the time display, for example the hour and minute displays of the timepiece.

BACKGROUND OF INVENTION

In the conventional type of electronic timepiece, the switching required for setting or adjusting the time display is effected by bringing a switching member into and out of contact with a projecting portion of a pin which is mounted on a dielectric base plate. This construction has the disadvantage that the mounting of the contact pin is complicated and by reason of the projection of the pin from the base plate it is impossible to make a thin type watch. Furthermore, the pin may become loosened by the repeated contact of the switching member whereby contact of the pin with a printed circuit on the dielectric base plate is broken.

SUMMARY OF THE INVENTION

It is an object of the present invention to eliminate the difficulties and disadvantages of the prior construction. In accordance with the invention, openings are provided in a dielectric base plate and stationary contacts or electrodes of a switch mechanism are provided on the inner walls of these openings. Movable contacts carried by a switch lever extend into the openings in the dielectric base plate and are normally out of engagement with the stationary electrodes. The switch lever is movable, for example by manipulation of the watch stem so as to bring one or another of the movable contacts into engagement with the respective stationary electrode so as to close the switch. By reason of the switch electrodes being disposed in openings in the dielectric base plate rather than as projecting pins, the difficulties heretofore encountered are eliminated and it is possible to produce a thinner timepiece.

BRIEF DESCRIPTION OF DRAWINGS

An example of the prior art and the nature, objects and advantages of the present invention will be understood from the following description in conjunction with the accompanying drawings in which.

DESCRIPTION OF PRIOR ART CONSTRUCTION

Figure 1:
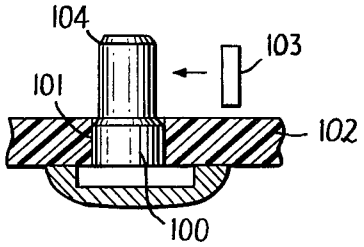
FIG. 1 PRIOR ART
FIG. 1 is a fragmentary schematic cross sectional view illustrating an example of the prior art.

In a conventional type of switching mechanism as illustrated by way of example in FIG. 1, a pin 100 is mounted in a hole 101 of a dielectric base plate 102. A switching spring member 103 is alternatively brought into contact with and released from the projecting portion 104 of the pin 100 whereupon ON and OFF operations are attained. However, the operation of mounting the pin 100 in the base plate 102 is contemplated and by reason of the projection of the pin from the base plate it is impossible to make a thin type watch. Moreover, repeated contact of the switching spring member 103 with the pin 100 tends to loosen the pin in the base plate so as to break continuity between the pin and a printed circuit on the base plate.

DESCRIPTION OF PREFERRED EMBODIMENTS OF INVENTION

Figure 2:
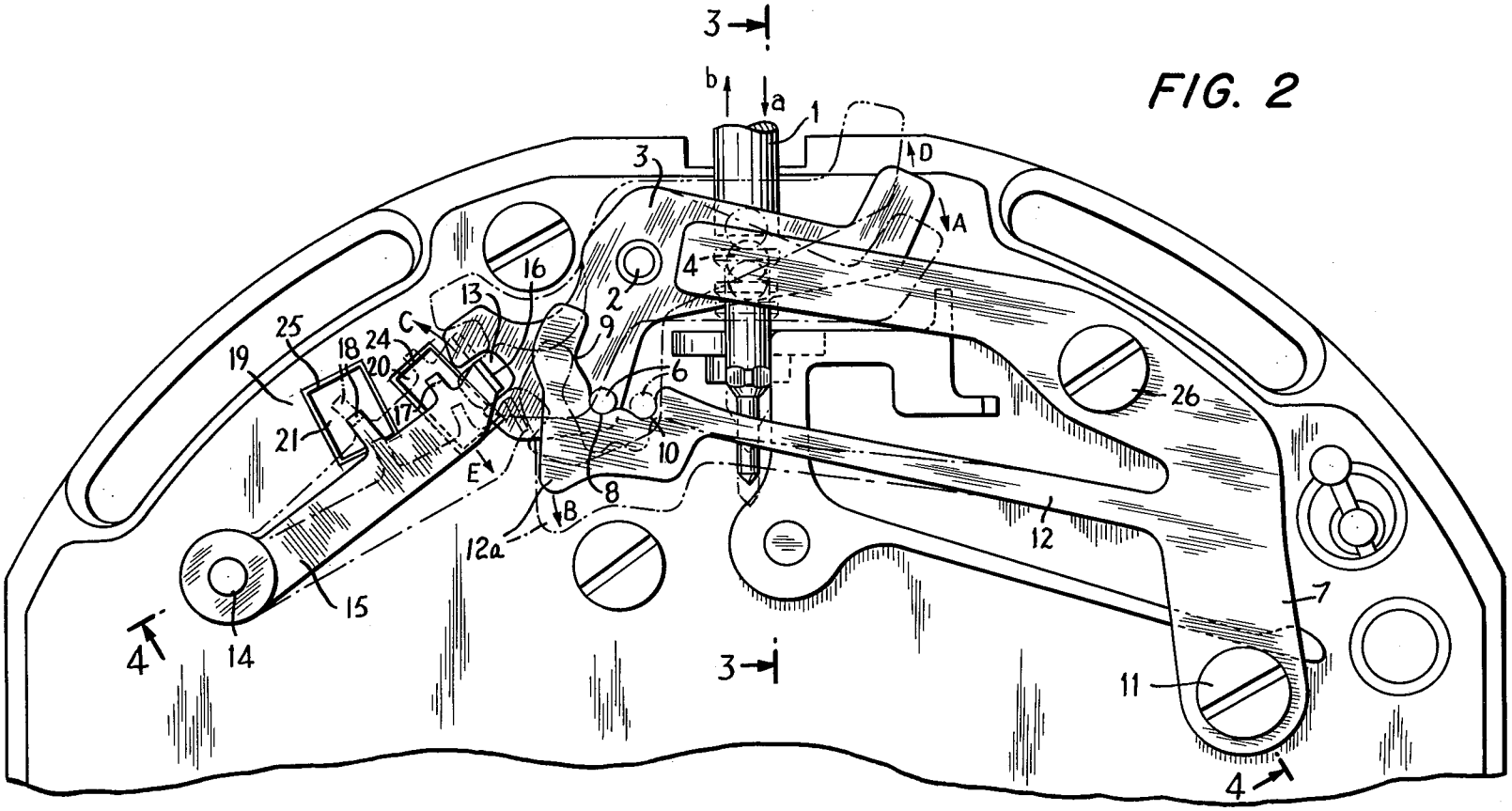
FIG. 2 is a plan view of switching mechanism in accordance with the present invention.
Figure 3:
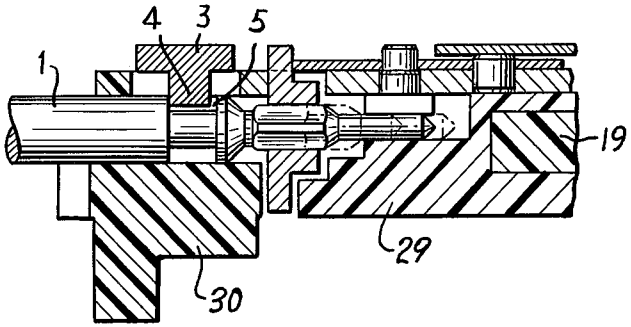
FIG. 3 is a cross sectional view taken approximately on the line 3—3 in FIG. 2.
Figure 4:
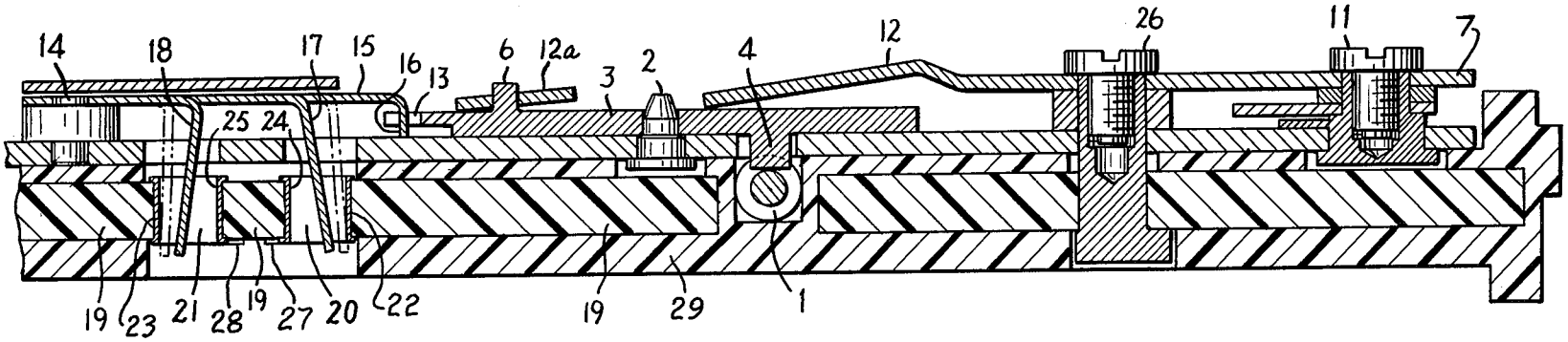
FIG. 4 is a sectional view taken approximately on the line 4—4 in FIG. 2 but with parts shown in a common plane to facilitate illustration.

In FIGS. 2 to 4, there is shown by way of example a switching mechanism in accordance with the present invention as applied to an electronic watch. A dielectric base plate 19 is set in a plastic base or envelope 29. A stem member 1 extends through the case or frame 30 of the watch and is movably mounted in an axial direction relative to the watch movement. A swing member 3 which is pivotally mounted on the dielectric base plate 19 by a pivot pin 2 has a pin or projection 4 which engages in an annular channel portion 5 of the stem member 1 whereby the swing member 3 can be swung about its pivot 2 by axial movement of the stem member 1. A pin 6 for determining the location of the swing member 3 is provided on the swing member in position to be received in one or more of adjacent grooves or recesses 8, 9 and 10 provided in an edge of an end portion **12*a* of an elongated spring arm 12 of a supporting member 7 which is mounted on the base plate by means of screws 11 and 26. Furthermore, an end portion of the swing member 3 is provided with a recess 13 which receives a bent down end portion 16 of a switch level 15 which is pivotally mounted on the base plate by means of a pivot pin 14. The swing member 3 and switch lever 15 are thus interconnected so as to cooperate with one another in the manner that axial movement of the stem member 1 produces pivotal movement of the swing member 3 about its pivot 2 which in turn produces pivotal movement of the switch lever 15 about its pivot 14**.

The switch lever 15 has contact portions 17 and 18 which are bent down vertically so as to extend into openings 20 and 21 provided in a dielectric base plate 19 located under the switch lever 15. Metal coatings on the inner peripheral walls 22 and 23 of the openings 20 and 21 provide electrode portions 24 and 25 which are connected to circuit patterns 27 and 28 on the dielectric base plate 19. When the swing member 3 and switch lever 15 are in normal position with the pin 6 of the swing member 3 in recess 8 of the supporting member 7, the contact portions 17 and 18 are positioned in the openings 20 and 21 of the dielectric base plate 19 out of contact with the electrode portions 24 and 25.

When the stem member 1 is pushed inwardly in the direction of the arrow *a* in FIG. 2, the swing member 3 is rotated in a clockwise direction about its pivot 2 so that the pin 6 is moved from the recess 8 to the recess 9 in the supporting member 7. The outer end portion 12*a* of the spring arm 12 of the supporting member 7 is thereby moved in the direction of the arrow B against the spring bias provided by the spring arm 12. By reason of engagement of the end portion 16 in the recess 13 of the swing member 3, the switch lever 15 is moved in a counterclockwise direction about its pivot pin 14 as indicated by the arrow C. Contact portion 17 is thereby brought into contact with the electrode portion 24 as indicated by broken lines in FIG. 4. However, the contact portion 18 is not brought into contact with the electrode portion 25. When the stem member 1 is released, the end portion 12*a* of the arm 12 of the supporting member 7 is restored to its original condition by the spring force of the elongated spring arm 12 and acts through the pin 6 to swing the swing member 3 about its pivot in a counterclockwise direction as indicated by the arrow D in FIG. 1. Pin 6 is thereby restored to the recess 8. The switch lever 15 is rotated in a clockwise direction as indicated by the arrow E in FIG. 2 by the counterclockwise rotation of the swing member 3 and is thus restored to its original position in which the contact portion 17 is disengaged from the electrode portion 24 and thus restored to an OFF position.

If starting with the parts in normal position the stem member 1 is pulled outwardly in the direction indicated by the arrow *b* in FIG. 2, the swing member 3 is rotated about its pivot 2 in a counterclockwise direction as indicated by the arrow D in FIG. 2 whereby the pin 6 is moved from the recess 8 to the recess 10 against the spring power of the spring arm 12 of the supporting member 7 as indicated by the arrow B in FIG. 2. However, when the pin 6 is seated in the recess 10, the spring arm 12 of the supporting member 7 is restored to its original location so that it does not bias the swing member 3 to return to its original position. The switch lever 15 is rotated about its pivot pin 14 in a clockwise direction as indicated by the arrow E in FIG. 2 by the counterclockwise rotation of the swing member 3 whereby the contact portion 18 of the switch lever is brought into contact with the electrode portion 25 in the opening 21 of the dielectric base plate 19. The contact is thus in the ON position to close the circuit. In this condition the contact portion 17 is not in engagement with the electrode portion 24 in the opening 20 of the dielectric base plate 19 and thus remains in OFF position.

In the condition just described the spring arm 12 of the supporting member 7 is not displaced and hence there is no spring power tending to restore the parts to their original position. Therefore, the condition in which the pin 6 is in recess 10 is maintained even when the stem member is released and accordingly contact portion 18 remains in contact with the electrode portion 25 so that the switch is in ON condition. When the stem member 1 is pushed, the swing member 3 is rotated in a clockwise direction as indicated by the arrow A in FIG. 2 and pin 6 on the swing member 3 is restored from recess 10 to recess 8. The switch lever 15 is rotated in a counterclockwise direction as indicated by the arrow C in FIG. 2 by rotation of the swing member 3 in a clockwise direction whereby the contact portion 18 is disengaged from the electrode portion 25 so that the switch is in OFF position.

Therefore, the operational location of the swing member 3 is controlled by the detent system provided by the pin 6 and the spring arm 12 of the supporting member 7 and the contact portions 17 and 18 of the switch lever 15 are correctly operated. When the embodiment of the invention as illustrated in FIGS. 2 to 4 is employed as the switching means for time adjustment, the contact portions 17 and 18 are brought into contact with the electrodes 24 and 25 whereby an adjusting or setting signal is applied to the time adjusting mechanism. The switching operation of the contact portions 17 and 18 is attained by the pivotal movement of the switch lever 15 under control of the stem member 1 and swing member 3. For example, adjustment of the hour display of the watch is operated by the switching operation of the contact portion 17 while the adjustment of the minute display is operated by the switching operation of the contact portion 18.

According to the present invention, the contact portions 17 and 18 of the switch lever 15 directly contact the electrode portions 24 and 25 inside the openings 20 and 21 provided in the dielectric base plate 19 whereby the thickness of the switching mechanism is reduced and it is hence possible to construct a small thin type watch while attaining high reliability and low cost. The switching operation is attained by movement of the watch stem in an axial direction so that it is not necessary to mount any other pushbutton or device on the watch.

The operational location of the swing member is controlled by the detent system provided by the spring arm 12 of the supporting member 7 whereby the swinging angle of the switch lever is constantly controlled by the axial movement of the stem member and the contact portions are usually maintained in normal position.

Figure 5:
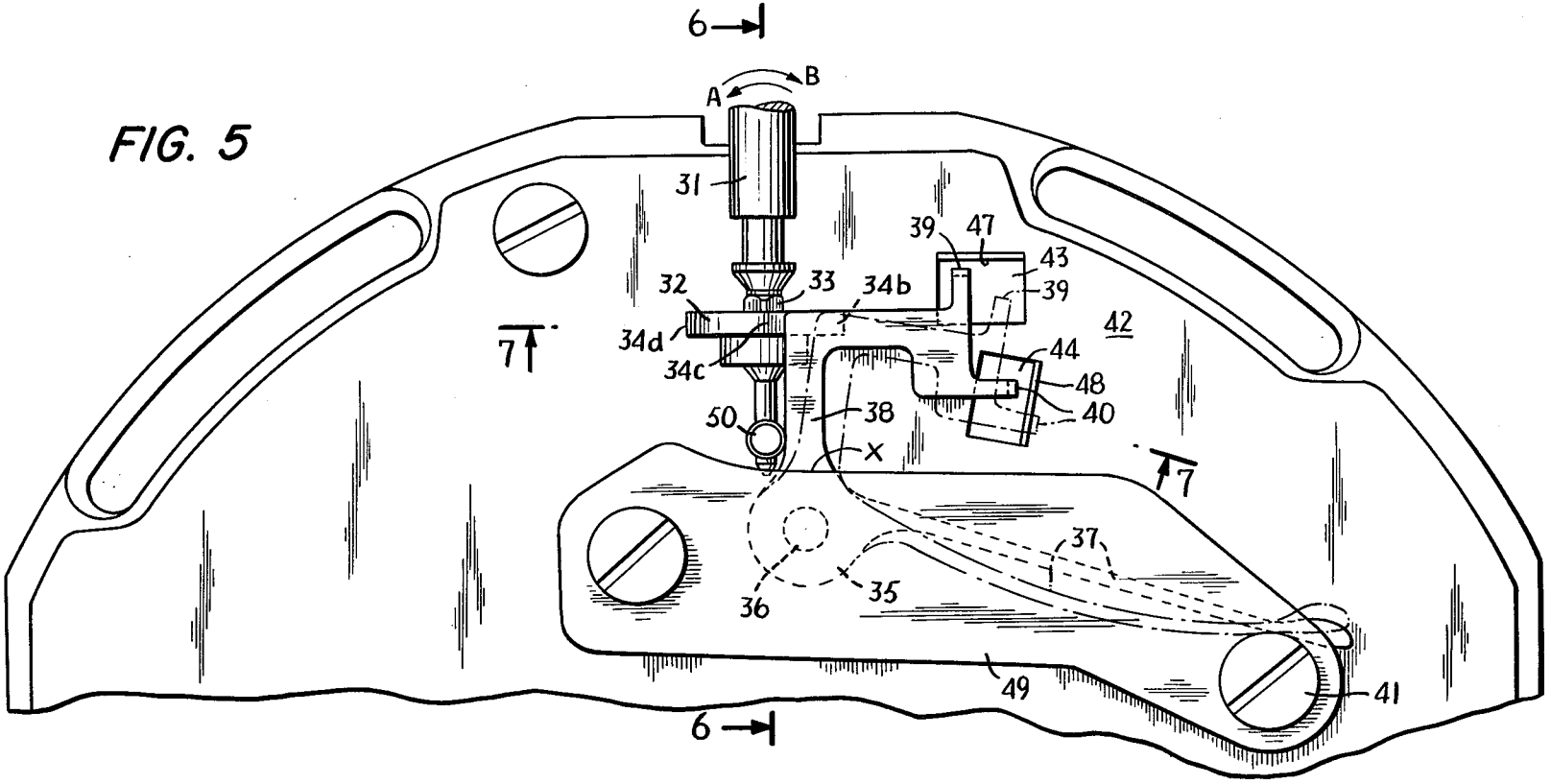
FIG. 5 is a plan view of a second embodiment of the invention.
Figure 7:
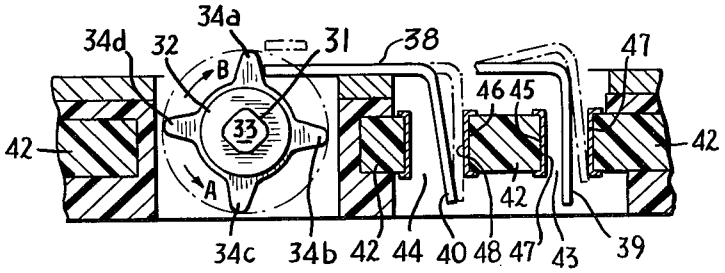
FIG. 7 is a sectional view taken approximately on the line 7—7 in FIG. 5 but with parts shown in a common plane to facilitate illustration.
Figure 6:
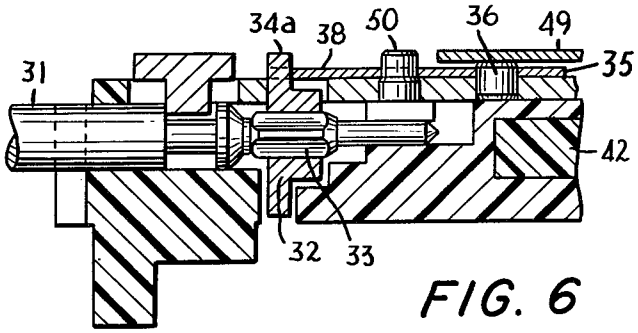
FIG. 6 is a sectional view taken approximately on the line 6—6 in FIG. 5.

A second embodiment of the invention is illustrated by way of example in FIGS. 5, 6 and 7. The stem member 31 is rotatably mounted and a switching cam 32 is mounted on a non-circular axial portion 33 of the stem so that the switching cam is rotated by rotation of the stem. As seen in FIG. 7, the switching cam 32 is provided on its periphery with four projecting portions 34*a*, 34*b*, 34*c* and 34*d*. A switching lever 35 is rotatably supported by a pivot pin 36 and comprises an elongated spring arm 37 and a second arm 38. An end portion of the spring arm 37 bears against one of the screws 41 by which a supporting plate 49 is mounted. The other arm 38 has contact portions 39 and 40 which are bent down as seen in FIG. 7 so as to extend into openings 43 and 44 in a dielectric base plate 42. Moreover, the arm 38 is adapted to be contacted by the projecting portions of the switching cam 32. The openings 43 and 44 in the dielectric base plate 42 located under the switch lever 35 have electrode portions 47 and 48 plated on the inner peripheral walls 45 and 46 of the openings and electrically connected with a circuit pattern on the dielectric base plate 42. With the parts in normal position, the contact portions 39 and 40 are inserted in the openings 43 and 44 without contacting the electrodes 47 and 48.

When the stem member 31 of the embodiment illustrated in FIGS. 5 to 7 is rotated in a counterclockwise direction as indicated by the arrow A in FIGS. 5 and 7, the switching cam 32 is rotated with the stem member in the same direction so that projecting portion 34*b* contacts the lower surface of the arm 38 of the switch lever 35 and thereby lifts the arm 38 to the position indicated by broken lines in FIG. 7. The projecting portion 34*b* of the switching cam 32 also applies a force to the arm 38 tending to move it toward the left as viewed in FIG. 5 but movement of the arm to the left is stopped by a pin 50. The arm 37 and the portion of the switch lever 35 adjacent the pivot pin 36 is held down by the supporting plate 49 whereby the switch lever 35 is not lifted up except for the portion of the arm 38 outwardly of the line designated by the reference character X. The contact portions 39 and 40 are moved upwardly by the upward movement of the arm 48, the movement of the contact portions being amplified by the ratio of the lever whereby contact portion 39 is brought into contact with the electrode portion 47 in the opening 43 of the dielectric base plate 42 and is thus on the ON position. However, in this condition the contact portion 40 does not engage the electrode 48 and stays in OFF position. Further rotation of the stem member 31 causes the projecting portion **34*b* of the cam member 32 to move out from beneath the arm 38 of the switch lever 35 whereupon the arm 38 is moved downwardly by its spring power and is restored to the original location. As a result, the contacted position of the contact portion 39 with the electrode portion 47** is released and thereby returned to OFF position.

When the stem member 31 is rotated in a clockwise direction as indicated by the arrow B in FIGS. 5 and 7, the switch cam member 32 is rotated together with the stem member 31 in the same direction whereby the projecting portion **34*a* engages the end portion of the arm 38 of the switch lever 35 and pushes the arm 38 toward the right as viewed in FIG. 5. The switch lever 35 is thereby rotated in a clockwise direction as viewed in FIG. 5 about the pivot pin 36 causing contact portions 39 and 40 to move in a circular path and thereby bring contact portion 40 into contact with the electrode portion 48 and thus be in an ON position. However, in this condition the contact portion 39 does not engage the electrode portion 47** and stays in an OFF condition.

FIGS. 8 to 11 illustrate another embodiment in which switching mechanism in accordance with the invention is employed as the setting device for an electronic wristwatch. The stem member 51 is mounted for movement in an axial direction and has an annular recessed portion 55 which receives a projection 54 on a swing member 53 which is pivoted on the base plate 69 by a pivot pin 52 so that axial movement of the stem member 51 produces pivotal movement of the swing member 53. A pin member 56 on the swing member 53 is adapted to engage in one or another of adjacent recesses 58, 59 and 60 in an edge of an end portion **62*a* of an elongated spring arm 62 of a supporting member 57 which is mounted on the base plate by screws 61 and 80. A recess 63 in an end portion of the swing member 53 receives a bent down end portion 66 of a switch lever 65 which is horizontally and rotatably supported by a pivot pin 64. The switch lever 65 and swing member 53 are thereby interconnected so that pivotal movement of the switch member 53 produces rotation of the switch lever 65 about its pivot 64. Contact portions 67 and 68 are bent down from the plane of the switch lever 65 so as to extend into openings 70 and 71 provided in a dielectric base plate 69 located under the switch lever 65. Metal coatings on the peripheral inner walls 72 and 73 of the openings 70 and 71 provide electrode portions 75 and 76 which are connected to circuit patterns 74 and 79 on the dielectric base plate 69. In the normal position of the switch lever 65, the contact portions 67 and 68 extend into the openings 70 and 71 of the dielectric base plate 69 without contacting the electrode portions 75 and 76**.

Figure 8:
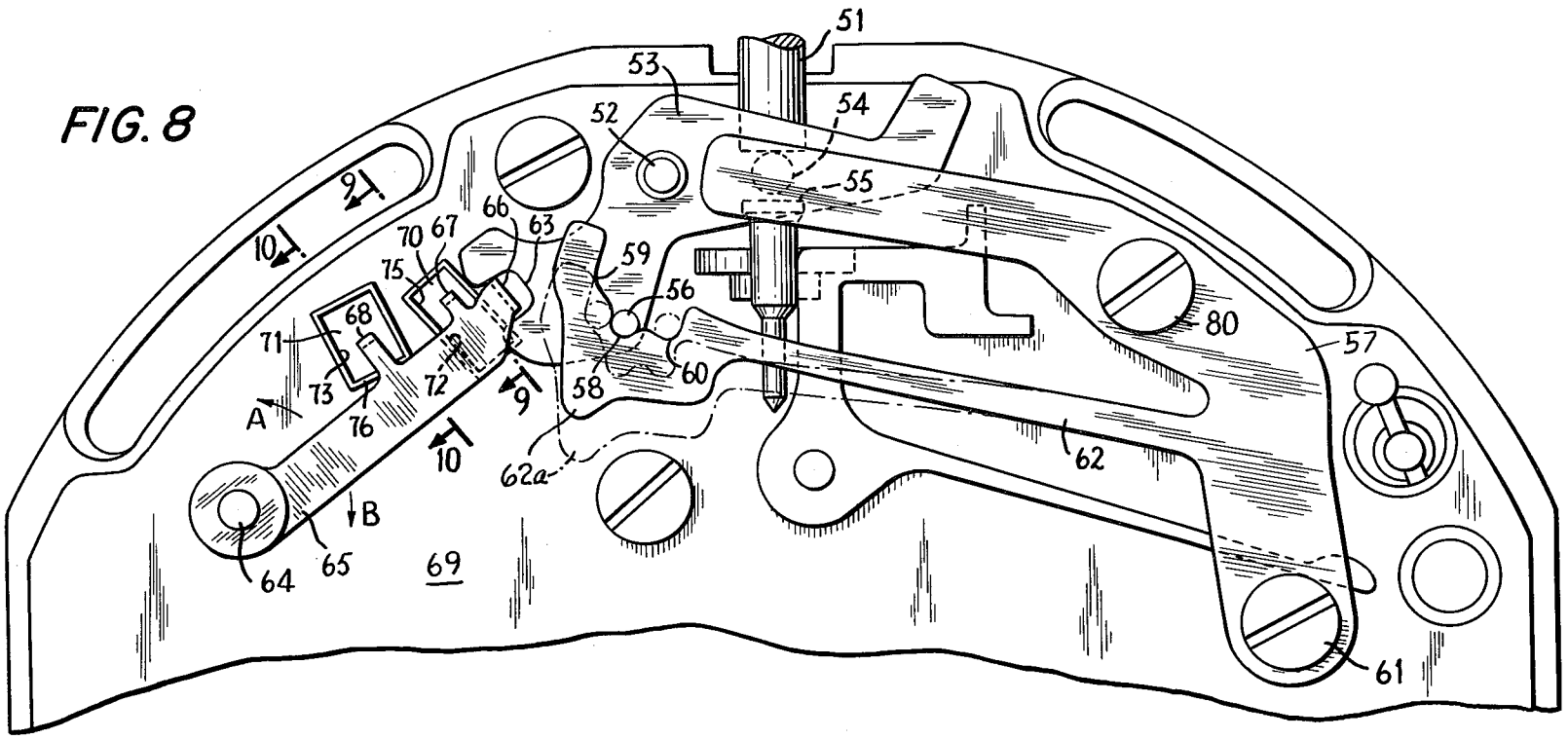
FIG. 8 is a plan view of a further embodiment of the invention.

When the stem 51 of the embodiment illustrated in FIGS. 8 to 11 is pushed in from its normal position, the swing member 53 is rotated in a clockwise direction as viewed in FIG. 8 about the pivot pin 52 and the pin member 56 is moved from recess 58 to recess 59 of the end portion **62*a* of the spring arm 62 of the supporting member 57. By reason of the connection provided by the end portion 66 of the switch lever engaged in the recess 63 of the swing member 53, the rotation of the swing member 53 in a clockwise direction produces rotary movement of the switch lever 65 in a counterclockwise direction about its pivot pin 64 as indicated by the arrow A in FIG. 8. The contact portion 67 of the switch lever is thereby brought into contact with the electrode portion 75 as indicated by dotted lines in FIG. 9. However, the contact portion 68 is not brought into contact with the electrode portion 76**.

When the stem member 51 is released, the supporting member 57 is restored to its original position by the spring force of the spring arm 62 whereby the swing member 53 is rotated in a clockwise direction as viewed in FIG. 8 and the pin member 56 is restored to the recess 58. The switch lever 65 is thereby rotated in a clockwise direction as indicated by the arrow B in FIG. 8 and the connection of the contact portion 67 with the electrode portion 75 is released so that the switch comes to an OFF position. By reason of the control provided by the location of the pin 56 and recess 58, the switch lever 65 is not moved beyond its normal position and hence the contact portions 67 and 68 are located out of contact with the electrode portions 75 and 76.

When the stem member 51 is pulled outwardly from its normal position, the swing member 53 is rotated in a counterclockwise direction as viewed in FIG. 8 about the pivot pin 52. The pin 56 on the swing member 53 is moved from the recess 58 to the recess 60. At this time although the spring arm 62 of the supporting member 57 is flexed momentarily, it comes back to approximately the same position when the pin 56 engages in the recess 60. Rotation of the swing member 53 in a counterclockwise direction causes rotation of the switch lever 65 in a clockwise direction about its pivot pin 64 as indicated by the arrow B in FIG. 8. Contact portion 68 of the switch lever is thereby brought into contact with the electrode portion 76 as indicated in dotted lines in FIG. 10 and hence is in ON position. However, the contact portion 67 does not contact the electrode 75. In this condition, a change of location of the supporting member 57 is not caused since the spring power of the spring arm 62 does not tend to restore the swing member 53 and switch lever 65 to their normal positions. Hence, when the stem member 51 is released, the switch lever stays in the position to which it has been moved and hence the contact portion 68 is continuously maintained in contact with the electrode portion 76. When the stem member 51 is pushed in, the swing member 53 is rotated in a clockwise direction as viewed in FIG. 8, the pin 56 is returned from the recess 60 to the recess 58 and the switch lever 65 is rotated in a counterclockwise direction by the rotation of the swing member 53 is a clockwise direction so that the contact portion 68 with the electrode 76 is released and thus is restored to an OFF position.

Figure 11:
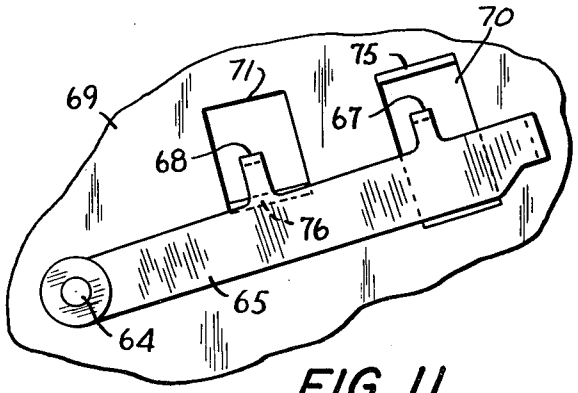
FIG. 11 is a partial schematic plan view illustrating a modification.
Figure 10:
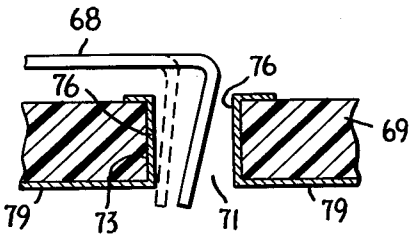
FIG. 10 is a fragmentary cross section taken approximately on the line 10—10 in FIG. 8.
Figure 9:
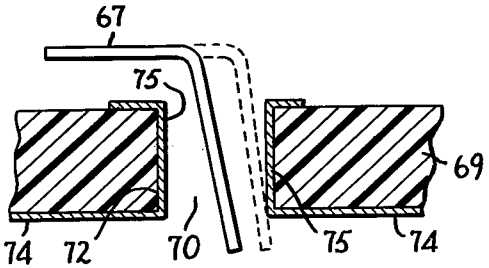
FIG. 9 is a fragmentary and enlarged section taken approximately on the line 9—9 in FIG. 8.

When the contact portions 67 and 68 are contacted to the electrode portions 75 and 76 and are thus in ON position, the time adjusting signal is applied whereby the time adjusting mechanism is operated. The swinging operation of the two contact portions 67 and 68 is changed by pivotal movement of the switch lever 65 by manipulation of the watch stem whereby the switching operation of the time adjusting signal is attained. Although in this embodiment, the electrode portions 75 and 76 completely cover the inner peripheral walls 72 and 73 of the openings 70 and 71 in the dielectric base plate 69, it is possible to shape the electrode portions 75 and 76 so as only partially to cover the inner walls 72 and 73. This is illustrated in FIG. 11 where the electrode portions 75 and 76 are shown on one side only of the openings 70 and 71.

While this embodiment of the invention relates to an electronic watch, it will be understood that the invention is also applicable to other electronic instruments, for example radios and tape recorders. Moreover, various modifications of the invention will occur to those skilled in the art.

What I claim is:

1. A switch mechanism for an electronic timepiece and other electronic equipment comprising a dielectric base plate having at least one opening therein and having circuitry thereon, said opening having an inner peripheral wall, a fixed electrode portion on said inner peripheral wall of said opening, a switch lever pivotally mounted on said base plate and having at least one movable contact portion extending into said opening, and means for moving said switch lever to move said contact portion parallel to said base plate selectively between an ON position in which said contact portion of said switch lever contacts said fixed electrode and an OFF position in which said contact portion of said switch lever does not contact said fixed electrode.

2. A switch mechanism according to claim 1, in which said dielectric base plate has a plurality of said openings therein, each with an inner peripheral wall and a fixed electrode on said inner peripheral wall thereof, and in which said switch lever has a corresponding plurality of said movable contact portions each extending into a respective opening in said dielectric base plate.

3. A switch mechanism according to claim 2, in which said switch lever is movable in one mode to move one of said contact portions into contact with the respective fixed electrode in one said opening in said dielectric base plate and is movable in another mode to move another of said contact portions into contact with the respective electrode in another said opening in said dielectric base plate.

4. A switch mechanism for an electronic timepiece according to claim 1, in which said means for moving said switch lever comprises a stem member and means connecting said stem member with said switch lever.

5. A switch mechanism according to claim 4, in which said connecting means comprises a swing member pivotally mounted on said base plate, means interconnecting said swing member with said stem member for movement of said swing member of said stem member and means interconnecting said swing member with said switch lever for movement of said switch lever by said swing member.

6. A switch mechanism according to claim 5, comprising resilient means for controlling movement of said swing member selectively to retain it in a set position and to return it form one position to another.

7. A switch mechanism according to claim 4, in which said stem member is rotatable and in which said connecting means comprises a cam member disposed on and rotatable with said stem member and having projecting portions engageable with said switch lever to move it.

* * * * *